US005469019A

United States Patent [19]

Mori

[11] Patent Number: 5,469,019

[45] Date of Patent: Nov. 21, 1995

[54] THIN ELECTROLUMINESCENT LAMP AND PROCESS FOR FABRICATING THE SAME

[75] Inventor: Naoyuki Mori, Shiga, Japan

[73] Assignee: NEC Corporation, Tokyo, Japan

[21] Appl. No.: 201,395

[22] Filed: Feb. 24, 1994

[30] Foreign Application Priority Data

Feb. 24, 1993 [JP] Japan ..... 5-033877

[51] Int. Cl.[6] ..... H01J 1/54; H01J 9/24; G09G 3/10

[52] U.S. Cl. ..... 313/509; 313/502; 313/512; 445/24; 315/169.3; 428/917

[58] Field of Search ..... 313/509, 511, 313/502, 512; 445/24; 315/169.3; 428/917, 690

[56] References Cited

U.S. PATENT DOCUMENTS

| | | | |
|---|---|---|---|
| 4,020,389 | 4/1977 | Dickson et al. | 313/509 |
| 4,066,925 | 1/1978 | Dickson | 313/509 |
| 4,560,902 | 12/1985 | Kardon | 313/502 |
| 5,076,963 | 12/1991 | Kameyama et al. | 313/509 |
| 5,276,382 | 1/1994 | Stocker et al. | 313/511 |
| 5,332,946 | 7/1994 | Eckersley et al. | 313/511 |

FOREIGN PATENT DOCUMENTS

| | | |
|---|---|---|
| 63-112795 | 7/1988 | Japan . |
| 238482 | 2/1990 | Japan . |
| 2276193 | 11/1990 | Japan . |
| 4230996 | 8/1992 | Japan . |

*Primary Examiner*—Sandra L. O'Shea
*Assistant Examiner*—Matthew J. Esserman

[57] ABSTRACT

An electroluminescent lamp has a face side laminated film and a rear side laminated film. The face side laminated film is constituted by sequentially formed layers including a transparent electrode, a luminous layer formed of a moistureproof-coated phosphor powder distributed in fluororesin such as vinylidene fluoride which is a low hygroscopic resin, and a reflective insulation layer formed of a high dielectric material distributed in fluororesin. The rear side laminated film is constituted by sequentially formed layers including a film such as a PET film, an adhesive layer, and a rear electrode which is formed of a conductive material such as carbon paste or nickel paste having a migration property lower than that of silver (Ag) and which is thermally-compress-bonded to the reflective insulation layer. This arrangement makes it possible to omit such outer coat films and hygroscopic films as used in the prior art arrangement.

8 Claims, 8 Drawing Sheets

THIN ELECTROLUMINESCENT LAMP AND PROCESS FOR FABRICATING THE SAME

BACKGROUND OF THE INVENTION (1) Field of the Invention

The present invention relates to an electroluminescent lamp and a process for fabricating the same, and more particularly to an ultra-thin electroluminescent lamp without using outer coat films and a method for fabricating such lamp.

(2) Description of the Related Art

A conventional electroluminescent lamp of the kind to which the present invention relates is first explained to assist the understanding of the present invention. As shown in FIG. 1, the conventional electroluminescent lamp 30 is configured such that an electroluminescent element 27 in the form of a laminator and generally in a rectangular shape in a plane view, as described later, is sealed with outer coat films 28 and 29 formed of fluororesin or the like having moistureproof property.

The electroluminescent element 27 is formed by laminating a rear electrode 21, a reflective insulation layer 22, a luminous layer 23, and a transparent electrode 24 in this order from the under side. The numerals 25 and 26 in FIG. 1 denote hygroscopic layers which are constituted by hygroscopic films of such as polyamides and are respectively disposed on the top and the bottom of the electroluminescent element 27. Generally, an electroluminescent lamp is formed in the form of a thin flat-panel luminescent body, and the thickness thereof is approximately 1 mm. However, when such luminescent body is used for a backlight for a liquid crystal display for use in pocket bells, pagers and the like, it is required for the luminescent body to have a thickness of approximately 0.3 mm. What has been done conventionally to meet such requirement is to make the hygroscopic films 25, 26 and outer coat films 28, 29 as thin as possible within the limit of the moisture-proof capability.

However, for reducing the thicknesses of the hygroscopic films and the outer coat films in the ways as described above, there is a limit in the reduction because the life is affected under high moisture environment. Thus, the limit to the thickness of the electroluminescent lamp has been 0.8 mm for maintaining the reliability under high moisture. For solving this problem, many attempts have been made to reduce the thicknesses of respective layers or to omit package films. For example, by changing the transparent electrode or the rear electrode to that of a printed-type using electrically conductive paste, it is possible to make such reduction by the thicknesses corresponding to the materials used for a transparent film and the metal foil used for the rear electrode. However, the thickness that can be reduced thereby will be only in the order of 0.1 mm. In addition, as described in Japanese Utility Model Application Kokai Publication No. Sho 63-112795 and Japanese Patent Application Kokai Publication No. Hei 2-276193, when the printed-type is used, the luminous layer and the reflective insulation layer tend to have pin holes resulting in deterioration of insulation characteristics, so that a process for flattening such layers is additionally required. In another example, as disclosed in Japanese Patent Application Kokai Publication Nos. Hei 2-38482 and Hei 4-230996, the outer coat films are omitted by using phosphor microcapsuled with an oxide compound having moistureproof property for the luminous layer. Although the use of such phosphor enables to omit the outer coat films, the high dielectric resin used for a binder has high hygroscopicity under high humid conditions and this causes various problems such as water penetration, short-circuitting, excess current flow and element breakdown.

SUMMARY OF THE INVENTION

It is, therefore, an object of the present invention to overcome the problems existing in the prior art as described above and to provide an ultra-thin electroluminescent lamp which is capable of preventing the life deterioration thereof without using such outer coat films or hygroscopic films as used in the prior art and which does not suffer from the deterioration in the insulation characteristics and the deformation thereof.

According to one aspect of the invention, there is provided an electroluminescent lamp comprising:

- a transparent electrode formed on a transparent film;
- a luminous layer formed of a moistureproof-coated phosphor powder distributed in fluororesin;
- a reflective insulation layer formed of a high dielectric material distributed in fluororesin; and
- a rear electrode formed of a conductive material having a migration property lower than that of silver and thermally-compress-bonded to the insulation layer.

According to another aspect of the invention, there is also provided a process for fabricating an electroluminescent lamp, the process comprising the steps of:

- forming a luminous layer and then a reflective insulation layer on a transparent conductive film;
- forming an adhesive layer on a separate film;
- forming a rear electrode on the adhesive layer; and
- bonding the rear electrode and the insulation layer together by a thermocompression bonding process.

In the electroluminescent lamp according to the present invention, the luminous layer and the reflective insulation layer are formed in this order on the transparent electrode provided on the transparent film. The luminous layer consists of a low hygroscopic resin, such as vinylidene fluoride, and a moistureproof-coated phosphor powder, and the reflective insulation layer consists of a low hygroscopic resin, such as vinylidene fluoride and a high dielectric material. On a separate film, an adhesive layer is formed, and the rear electrode consisting of a low migration material, such as carbon paste or nickel paste, is formed on the adhesive layer, the rear electrode being thermally-compress bonded using a laminator, a hot press, etc. The transparent film and the separate film are of the same material.

Since the low migration material is used for the rear electrode, the low hygroscopic material is used for the resin to be used for the reflective insulation layer and the luminous layer, and the moistureproof-coated phosphor is used for the luminous layer, it is possible to omit such outer coat films and hygroscopic films as used in the prior art and to provide an ultra-thin electroluminescent lamp with the thickness being approximately one fourth of the thickness of the prior art electroluminescent lamp, and with the cost being low without impairing the life. Inasmuch as the interface between the reflective insulation layer and the rear electrode is under tight adhesion due to thermocompression bonding, the adverse effect that may be caused by pin holes in the reflective insulation layer can be eliminated, thereby preventing the luminous layer from losing its breakdown characteristics, and water from invading through the interface. Also, the detachment of the layers can also be prevented due to the improved adhesion force, thereby enabling to prevent the deterioration of the life of the luminescent lamp. Furthermore, since the substrate films in the face side and the rear side are composed of the same material, it is possible to provide easily and economically the electroluminescent lamp that does not suffer from warping and deformation under thermal shock and heating circulation.

BRIEF DESCRIPTION OF THE DRAWINGS

The above and other objects, features and advantages of the present invention will be apparent from the following description of preferred embodiments of the invention explained with reference to the accompanying drawings, in which.

PREFERRED EMBODIMENTS OF THE INVENTION

Now, preferred embodiments of the invention are explained hereunder with reference to the accompanying drawings.

Figure 1:
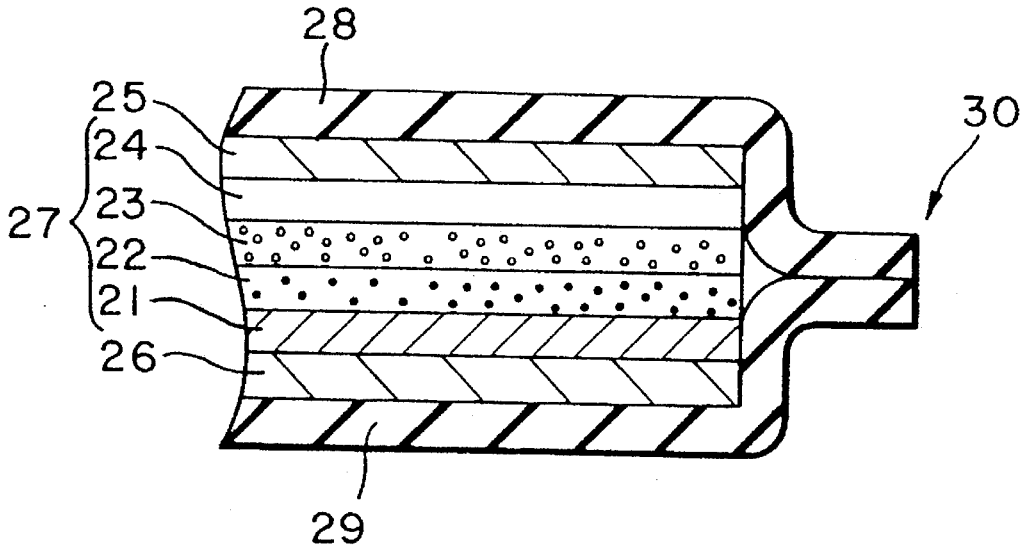
FIG. 1 PRIOR ART
FIG. 1 is an enlarged-section view of the essential portion of a conventional electroluminescent lamp.
Figure 2:
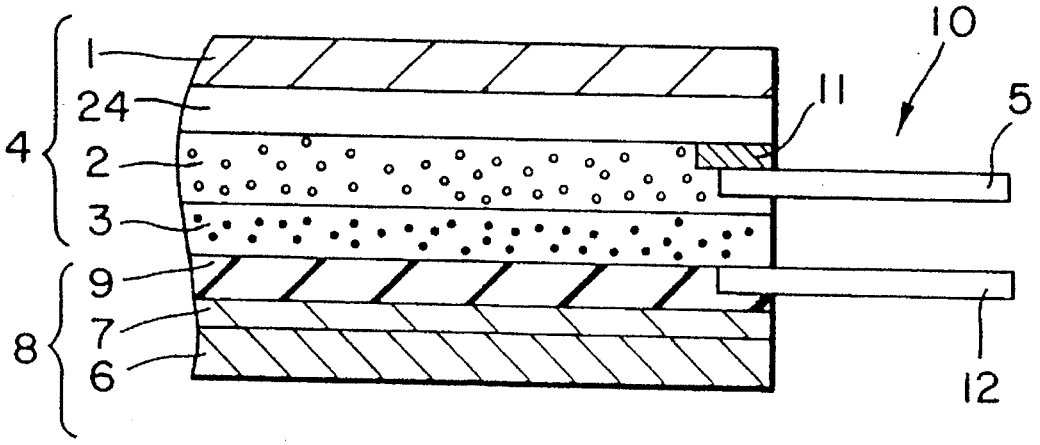
FIG. 2 is an enlarged-section view of the essential portion of the electroluminescent lamp according to a first embodiment of the invention.
Figure 3A:
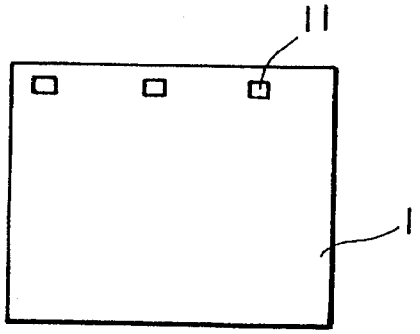
FIGS. 3A–3F are plane views for illustrating the fabrication steps for the electroluminescent lamp of the first embodiment of the invention.
Figure 3B:
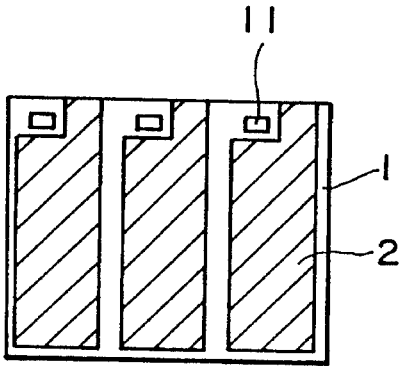
Figure 3C:
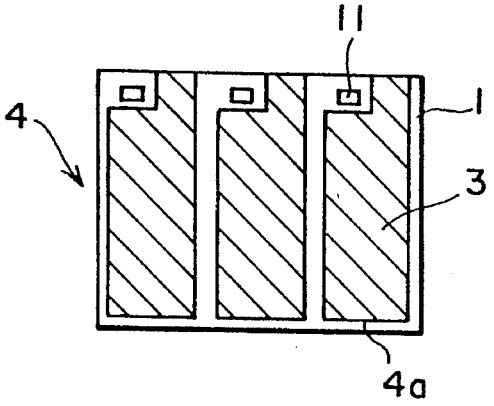
Figure 3D:
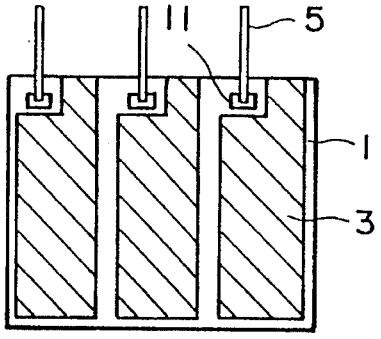
Figure 3E:
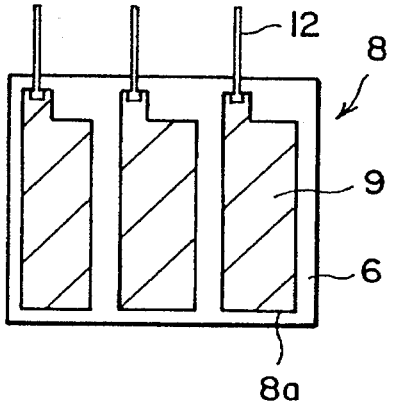
Figure 3F:
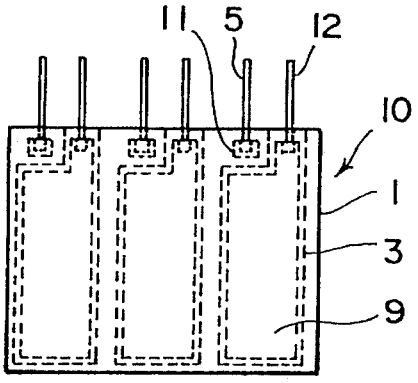

The arrangements and the fabrication steps of the electroluminescent lamp according to the first embodiment of the present invention are explained with reference to FIG. 2 and FIGS. 3A–3F. The electroluminescent lamp 10 of the present invention has an arrangement as illustrated in FIG. 2 which is an enlarged sectional view of the essential portion thereof. FIGS. 3A–3F are plane views for showing the sequential fabrication steps. As shown in FIG. 3A, an electrical contact pad 11 composed of silver paste or the like is formed on a transparent conductive film 1, such as PET (polyethylene terephthalate) film on which ITO (indium-tin oxide) is formed of 75 μm thick. Then, as shown in FIGS. 3B and 3C, a luminous layer 2 and a reflective insulation layer 3 are screen-printed in this sequence. The electrical contact pad 11 may be alternatively provided on the first transparent electrode 24 as shown in FIG. 2, for example. In the luminous layer 2, a powder of moistureproof-coated phosphor (such as "TYPTE 20" of OSRAM SYLVANIA Inc.), the phosphor being one in which zinc sulfide is activated by copper, is distributed or suspended in vinylidene fluoride, fluororubber or the like. In the reflective insulation layer 3, a powder of an insulation material, such as barium titanate, is distributed in vinylidene fluoride, fluororubber or the like. Thus, a laminated film 4 is obtained, in which the two layers have thicknesses of about 50 μm and about 20 μm, respectively, and the selectively formed patterns avoid covering the electrical contact pad 11. Then, a lead electrode 5 is connected to the electrical contact pad 11 of the transparent conductive film 1 as shown in FIG. 3D. On the other hand, as shown in FIG. 3E, a rear electrode 9 composed of thermoplastic carbon paste and having a thickness of about 10 μm is selectively screen-printed on an adhesive layer 7 (See FIG. 2) which is provided on a PET film 6 having a thickness of 75 μm. This results in a laminated film 8 with the rear electrode 9 having a pattern whose size is slightly smaller than the sizes of the reflective insulation layer 3 and the luminous layer 2 and whose shape is in a partially cut-out form (for preventing a possibility of short-circuiting to develop with, for example, the electrical contact pad 11). A lead electrode 12 is then connected to the end portion of the rear electrode 9 on the laminated film 8. Then, both the laminated films 4 and 8 are bonded together, with the reflective insulation layer 3 and the rear electrode 9 facing each other, by a thermocompression bonding process using a laminator, a hot press, etc., and this provides the electroluminescent lamp 10 (FIG. 3F). The electroluminescent lamp 10 obtained as described above has a thickness of 0.23 mm only (with a thickness of a lead electrode leading-out portion being 0.33 mm) which means that it has been enable to realize an ultra-thin electroluminescent lamp having approximately one fourth of the thickness of the conventional electroluminescent lamp.

Because the rear electrode 9 consisting of carbon paste is not formed on the peripheral edge portion 8*a* of the laminated film 8 and an adhesive layer 7 is exposed there, the peripheral edge portions 8*a* and 4*a* of the laminated films 8 and 4 can be bonded together firmly by means of thermocompression bonding, thus ensuring to prevent invasion of water or detachment to occur at peripheral edge portions. Moreover, since the carbon paste and the adhesive layer 7 are in a laminate form and not in a mixture state, this ensures that there will be no change in resistance values of the carbon paste.

The characteristics of the electroluminescent lamp 10 according to the invention obtained as described above are now explained hereinbelow in comparison with the conventional electroluminescent lamp. In the first place, the comparison in their initial electric characteristics is shown in TABLE 1.

TABLE 1

COMPARISON IN INITIAL ELECTRIC CHARACTERISTICS (At 100 V - 400 Hz)

| | Brightness (cd/m²) | Current Density (mA/cm²) | Power Consumption (mW/cm²) | Luminous Efficiency (lm/W) | Chrominance X | Chrominance Y |
|---|---|---|---|---|---|---|
| Inven- | 60.0 | 0.124 | 3.01 | 6.26 | 0.178 | 0.432 |

TABLE 1-continued

| | COMPARISON IN INITIAL ELECTRIC CHARACTERISTICS (At 100 V - 400 Hz) | | | | | |
|---|---|---|---|---|---|---|
| | Brightness (cd/m²) | Current Density (mA/cm²) | Power Consumption (mW/cm²) | Luminous Efficiency (lm/W) | Chrominance X | Chrominance Y |
| tion Prior Art | 55.0 | 0.122 | 2.60 | 6.64 | 0.178 | 0.431 |

Figure 4:
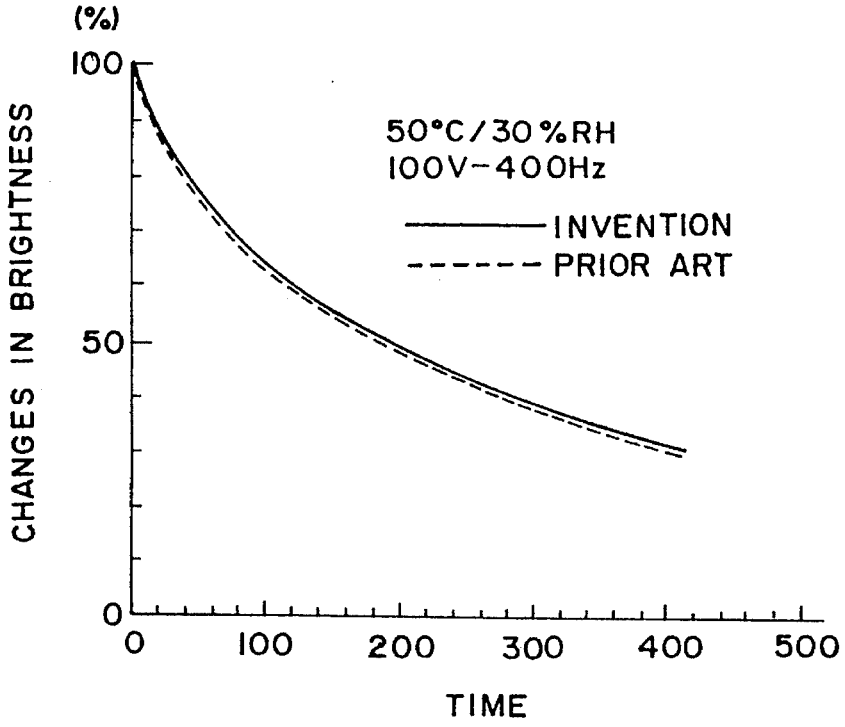
FIG. 4 is a graph for showing the life characteristics of the electroluminescent lamp of the first embodiment of the invention when driven at 100 V–400 Hz under a temperature of 50° C. and a relative humidity of 30%.
Figure 5:
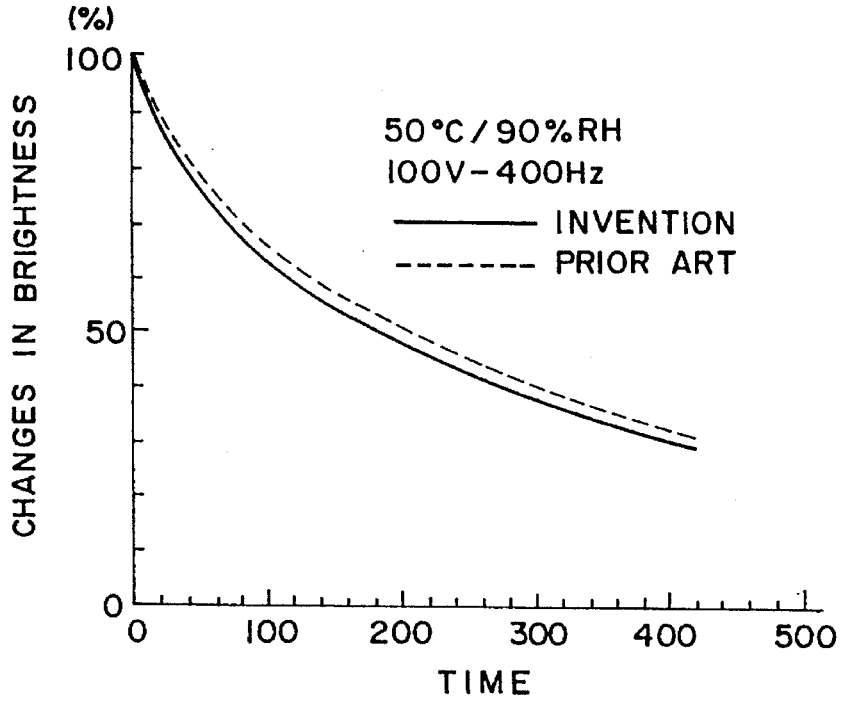
FIG. 5 is a graph for showing the life characteristics of the electroluminescent lamp according to the first embodiment of the invention when driven at 100 V–400 Hz under a temperature of 50° C. and a relative humidity of 90%.

FIG. 4 shows life characteristics of the electroluminescent lamps when driven at 100 V–400 Hz under a temperature of 50° C. and a relative humidity of 30%, and FIG. 5 shows life characteristics of the electroluminescent lamps when driven at 100 V–400 Hz under a temperature of 50° C. and a relative humidity of 90%, wherein a solid line denotes the electroluminescent lamp of the present invention while a broken line denotes the conventional electroluminescent lamp. As noted from FIGS. 4 and 5, despite the omission of sealing with outer coat films in the electroluminescent lamp of the present invention, the initial electric characteristics and the life characteristics either under dry atmosphere or high humid atmosphere were substantially equal to those of the conventional luminescent lamp which is sealed with outer coat films. The electroluminescent lamp is configured in a thin structure which can be fabricated at a low cost and with assurance for not suffering from poor insulation characteristics caused by pin holes, which may develop during the printing of the luminous layer and the reflective insulation layer. Moreover, since the electrical contact pad 11 formed on the transparent conductive film 1 and the rear electrode 9 formed on the PET film are not formed on the surfaces facing each other, no short-circuiting due to electromigration during driving operation may occur. Also, since a fluororesin having a low thermal expansion factor is used for the resin of the luminous layer and the reflective insulation layer, and the PET film of the same material and the same thickness is used for both the face side and the rear side in order to attain the same thermal expansion factor thereof, there is neither thermal shock nor warping during heating circulation.

Next, the second embodiment according to the present invention is described hereinbelow.

Figure 6A:
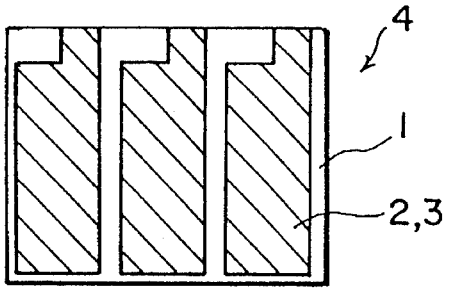
FIGS. 6A–E are plane views for illustrating the fabrication steps for the electroluminescent lamp according to a second embodiment of the invention.
Figure 6B:
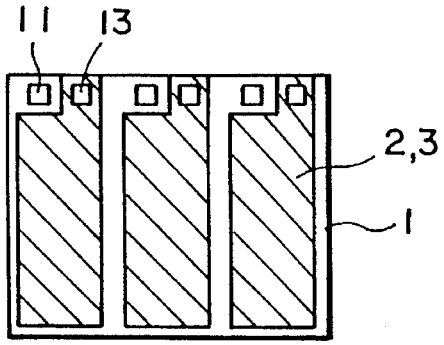
Figure 6C:
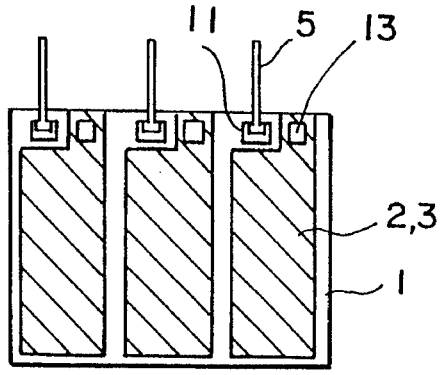
Figure 6D:
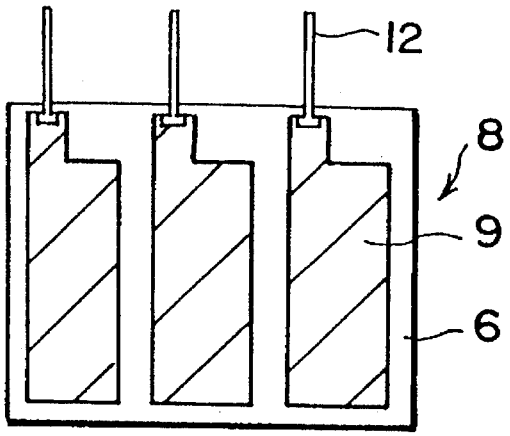
Figure 6E:
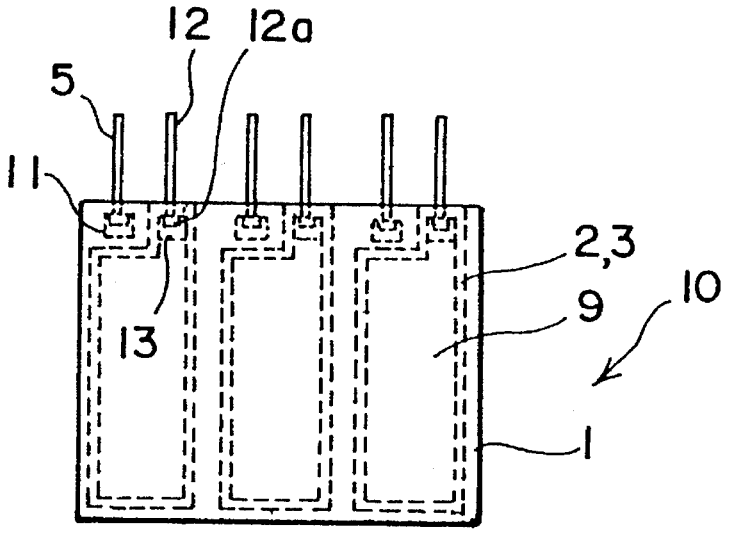
Figure 7:
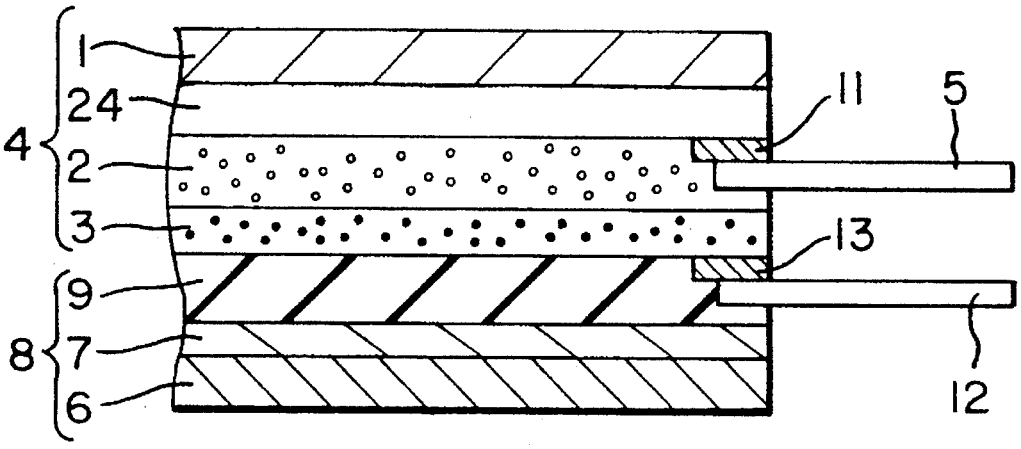
FIG. 7 is an enlarged-section view of the essential portion of the electroluminescent lamp according to the second embodiment of the invention.

In the first embodiment, an example wherein the leads 5, 12 are connected to the face side and rear side laminated films 4, 8, respectively, was explained. However, because the connecting portion of the leads is thick, a crack may develop in the carbon layer of the rear electrode when the rear side laminated film 8 is bonded to the face side laminated film 4 by a laminating roller, a hot press, etc., and such a crack can be a cause of loose contact in the connection. In the second embodiment, in order to prevent the loose contact, firstly a luminous layer 2 and a reflective insulation layer 3 are selectively formed in this order, according to the same procedure as for the first embodiment, by means of screen printing on the transparent conductive film 1 having a thickness of 75 μm, the two layers having thicknesses of about 50 μm and about 20 μm, respectively, whereby the laminated film 4 is formed as shown in FIG. 6A. Then, the electrical contact pads 11, 13 composed of silver paste or the like are formed on the transparent conductive film 1 and the reflective insulation layer 3, respectively, in spaced positions as shown in FIG. 6B, and the face side lead electrode 5 is connected onto the electrical contact pad 11 as shown in FIG. 6C. On the other hand, by means of screen printing, the rear electrode 9 which is composed of thermoplastic carbon paste and which has a thickness of 10 μm is selectively formed on the adhesive layer 7 formed on the PET film 6 having a thickness of 75 μm, whereby the laminated layer 8 is obtained. Then the lead electrode 12 is connected to the edge portion of the rear electrode 9 as shown in FIG. 6D. The electroluminescent lamp 10 is then obtained by bonding both the laminated films 4 and 8 using a laminator or a hot press. The electrical contact pad 13 and the lead electrode 12 are connected to the rear electrode 9 so that they overlap each other as shown in FIG. 6E. The rear side lead electrode 12 is clamped between the carbon layer used for the rear electrode 9 and the electrical contact pad 13 as seen in FIG. 7 which is an enlarged sectional view thereof, and the electrical contact pad 13 and the carbon layer can also be bonded together firmly because the area of the electrical contact pad 13 is wider than the area of the connection portion 12*a* of the lead electrode 12 as seen in FIG. 6E. Thus, the occurrence of loose contact between the layers is prevented.

Figure 9:
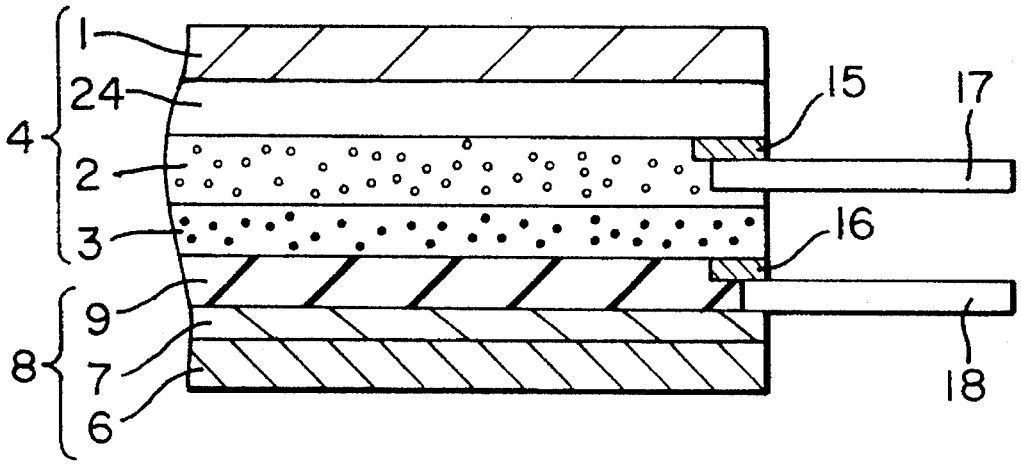
FIG. 9 is an enlarged-section view of the essential portion of the electroluminescent lamp according to the third embodiment of the invention.
Figure 8A:
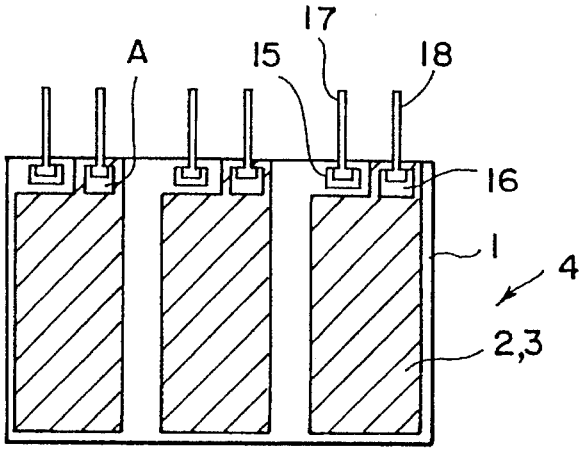
FIGS. 8A–C are plane views for illustrating the fabrication steps for the electroluminescent lamp according to a third embodiment of the invention.
Figure 8B:
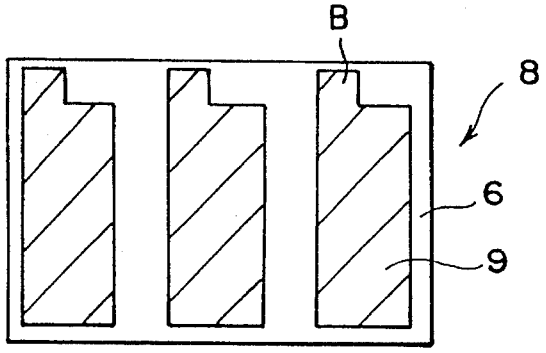
Figure 8C:
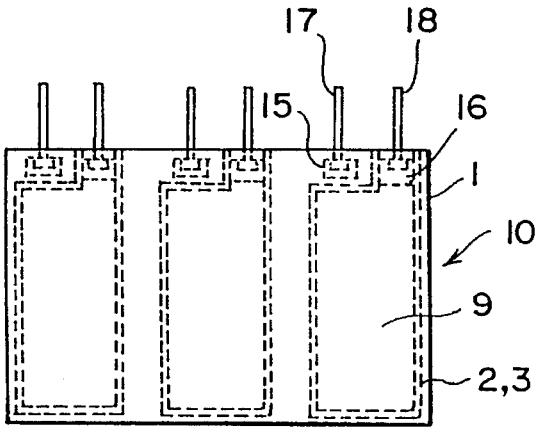

Now, the third embodiment of the present invention is described hereinbelow. In the first and second embodiments, the lead electrodes were led-out respectively from the face side transparent conductive film and the carbon paste layer used for the rear electrode. However, there is a case where the dimensional precision for leading-out the lead electrode is lost due to the mismatching developed during the bonding of the face side and rear side laminated films. The third embodiment is to improve the dimensional precision by eliminating a mismatching possibility, wherein a luminous layer 2 and a reflective insulation layer 3 having thicknesses of about 50 μm, and about 20 μm, respectively, are selectively formed on the film having a thickness of 75 μm in the mentioned order by means of screen printing in the same procedure as described for the first embodiment, whereby the laminated film 4 is formed. The electrical contact pads 15, 16 composed of silver paste or the like are formed on the transparent conductive film 1 and the reflective insulation layer 3, respectively, in spaced positions, and then lead electrodes 17, 18 are connected to the electrical contact pads 15, 16 as shown in FIG. 8A. On the other hand, by means of screen printing, a rear electrode 9 composed of a thermoplastic carbon paste having a thickness of about 10 μm, is selectively formed on an adhesive layer 7 formed on the PET film 6 having a thickness of 75 μm, whereby the laminated layer 8 is obtained as seen in FIG. 8B. Then, both the laminated films 4 and 8 are bonded together by means of thermocompression bonding using a laminator, a hot press, etc. in a state in which the reflective insulation layer 3 and the rear electrode 9 face each other and in which an extended portion (B portion) of the rear electrode 9 is brought in contact with a portion (A portion) where the lead electrode 18 for the electrical contact pad 16 shown, for example, in FIG. 8A is not connected, whereby the electroluminescent lamp 10 is obtained. According to this third embodiment, both the face side and rear side lead electrodes are connected to the same laminated film 4, whereby the accurate dimension for leading-out the lead electrodes can be obtained during thermocompression bonding of the face side and rear side laminated films. Also, as shown in FIG. 9, since the carbon paste layer used for the rear electrode 9 is in contact with the electrical contact pad 16 to which the rear side lead electrode 18 on the transparent conductive film 1 is attached, a possibility for cracks to occur in the carbon paste layer caused by clamping the lead electrodes is prevented, thereby enabling to enhance the quality of the electroluminescent lamp.

In the embodiments described above, the examples have been given on the printing of carbon paste as the rear electrode. However, the invention is not limited to those examples as it is possible to use other materials, such as nickel paste, or carbon and nickel in the form of a mixture, combination or laminate. In addition, a transparent electrode of such as ITO, metal thin film or metal foil, such as aluminum (Al), and any other material insofar as its electromigration property is lower than that of silver (Ag), can be used for the rear electrode. For a binder for forming the luminous layer and the reflective insulation layer, any materials that have low hygroscopicity can be used, and for an apparatus for bonding the face side and rear side laminated films, any apparatuses that are adapted to thermocompression bonding can be used.

According to the invention, outer coat films and hygroscopic films can be omitted in the electroluminescent lamp without impairing the life thereof, thereby enabling to provide at low cost an ultra-thin electroluminescent lamp whose thickness is as thin as approximately one fourth that of the conventional electroluminescent lamp. Furthermore, the electroluminescent lamp of the invention does not suffer from the poor insulation characteristics that may be caused by pin holes developed during the printing. Also, by using the same material for the substrate films of both the face side and the rear side thereof, it is possible to realize the electroluminescent lamp which does not suffer from thermal shock and warping during heating circulation.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. An electroluminescent lamp comprising:

a front side transparent film and a rear side transparent film;

a transparent electrode formed on said front side transparent film;

a luminous layer provided to said transparent electrode and being formed of a moistureproof-coated phosphor powder distributed in fluororesin;

a reflective insulation layer provided to said luminous layer and being formed of a high dielectric material distributed in fluororesin;

a rear electrode formed of a conductive material having a migration property lower than that of silver and thermally-compress-bonded to said reflective insulation layer; and an adhesive layer provided between said rear electrode and said rear side transparent film, said luminous layer, said reflective insulation layer and said rear electrode being in a laminate form and being positioned such that, between said front side transparent film and said rear side transparent film, a peripheral portion of said transparent electrode and a peripheral portion of said adhesive layer are extended and exposed, and such that a peripheral portion of said front side transparent film having said transparent electrode thereon and a peripheral portion of said rear side transparent film having said adhesive layer are in a securely thermally-compress-bonded state.

2. The electroluminescent lamp according to claim 1, in which said rear electrode is formed of paste selected from a group consisting of carbon paste and nickel paste, said rear electrode being provided on said adhesive layer in a region excepting said peripheral portion of said adhesive layer.

3. The elesctroluminescent lamp according to claim 1, in which said fluororesin is resin selected from a group consisting of vinylidene fluoride and fluororubber.

4. The electroluminescent lamp according to claim 2, in which said rear electrode is formed in a range within said reflective insulation layer.

5. The electroluminescent lamp according to claim 2, in which said rear electrode is formed in a range within said adhesive layer.

6. The electroluminescent lamp according to claim 2, in which said transparent film on which said transparent electrode is formed and said film on which said rear electrode is formed are of the same material.

7. An electroluminescent lamp comprising:

a first transparent film and a second transparent film;

a transparent electrode formed on said first transparent film;

a first electrical contact pad provided on said transparent electrode;

a luminous layer provided to said transparent electrode except at a peripheral portion of said transparent electrode including said first electrical contact pad, and being formed of a moistureproof-coated phosphor powder distributed in fluororesin;

a reflective insulation layer provided to said luminous layer and being formed of a high dielectric material distributed in fluororesin;

a second electrical contact pad provided to said reflective insulation layer;

a front side lead electrode conductive with said first electrical contact pad;

an adhesive layer formed on said second transparent film;

a rear electrode provided on said adhesive layer excepting a peripheral portion of said adhesive layer;

a rear side lead electrode which, while allowing said second electrical contact pad and said rear electrode to be conductive with each other, is disposed so as to be conductive with at least said second electrical contact pad out of said second electrical contact pad and said rear electrode, said peripheral portion of said transparent film and a peripheral portion of said second transparent film having said adhesive layer being in a securely thermally compress-bonded state.

8. An electroluminescent lamp comprising:

a front side transparent film and a rear side transparent film formed of the same material as said front side transparent film;

a transparent electrode formed on said front side transparent film;

a luminous layer provided to said transparent electrode and being formed of a moistureproof-coated phosphor powder distributed in fluororesin, said fluororesin being a resin selected from the group consisting of vinylidene fluoride and fluororubber;

a reflective insulating layer provided to said luminous layer and being formed of a high dielectric material distributed in fluororesin, said fluororesin being a resin selected from the group consisting of vinylidene fluoride and fluororubber;

a rear electrode of a conductive material formed of carbon paste and thermally-compress-bonded to said reflective insulation layer; and an adhesive layer provided between said rear electrode and said rear side transparent film;

said rear electrode being provided in a state such that a range in which said rear electrode is formed is not larger than a range in which said reflective insulation layer is formed, that a range in which said rear electrode is formed is smaller than a range in which said adhesive layer is formed, and that a peripheral portion of said front side transparent film having said transparent electrode and a peripheral portion of said rear side transparent film having said adhesive layer are in a securely thermally-compress-bonded state.

* * * * *